US007548234B2

(12) United States Patent
Kawata

(10) Patent No.: US 7,548,234 B2
(45) Date of Patent: Jun. 16, 2009

(54) DRIVING CIRCUIT FOR ELECTRO-OPTICAL DEVICE, ELECTRO-OPTICAL DEVICE, AND ELECTRONIC APPARATUS

(75) Inventor: Hirotaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 523 days.

(21) Appl. No.: 11/333,181

(22) Filed: Jan. 17, 2006

(65) Prior Publication Data

US 2006/0187171 A1 Aug. 24, 2006

(30) Foreign Application Priority Data

Feb. 22, 2005 (JP) ..... 2005-045131

(51) Int. Cl.
*G09G 5/00* (2006.01)

(52) U.S. Cl. ..... 345/204; 345/92; 345/93

(58) Field of Classification Search ..... 345/204, 345/92–100

See application file for complete search history.

(56) References Cited

U.S. PATENT DOCUMENTS 6,307,681 B1 * 10/2001 Aoki et al. ..... 359/645
6,323,697 B1 * 11/2001 Pavan ..... 327/94
2002/0063674 A1 * 5/2002 Chiang ..... 345/98
2003/0211662 A1 * 11/2003 Yamazaki et al. ..... 438/142
2004/0085029 A1 * 5/2004 Kimura ..... 315/291
2005/0156864 A1 7/2005 Fujikura

FOREIGN PATENT DOCUMENTS

| | | |
|---|---|---|
| CN | 1637838 | 7/2005 |
| JP | 2002-049331 A | 2/2002 |
| JP | 2002-049357 A | 2/2002 |
| KR | 2003-0076422 | 9/2003 |

* cited by examiner

*Primary Examiner*—Amare Mengistu
*Assistant Examiner*—Premal Patel
(74) *Attorney, Agent, or Firm*—AdvantEdge Law Group, LLC

(57) ABSTRACT

A driving circuit for an electro-optical device includes scan lines, data lines, and pixel portions, arranged in an image display region on a substrate. The driving circuit includes a data line driving circuit to supply a first sampling signal and a second sampling signal sequentially to the sampling switches. Each sampling switch to supply an image signal of an image signal line to each of the data lines corresponding to the first sampling signal and the second sampling signal. Each of the sampling switches includes a first transistor for sustaining the image signal according to the first sampling signal and a second transistor electrically connected in series to the first transistor for supplying the image signal sustained by the first transistor to the data lines according to the second sampling signal.

4 Claims, 10 Drawing Sheets

DRIVING CIRCUIT FOR ELECTRO-OPTICAL DEVICE, ELECTRO-OPTICAL DEVICE, AND ELECTRONIC APPARATUS

RELATED APPLICATION INFORMATION

The present application claims priority from Japanese Patent Application No. 2005-045131, filed on Feb. 22, 2005, the entire contents of which are hereby incorporated by reference.

BACKGROUND

1. Technical Field

The present invention relates to an electro-optical device such as a liquid crystal display device, and an electronic apparatus having the electro-optical device, such as a liquid crystal projector.

2. Related Art

According to the related art, in a liquid crystal display device employing an active matrix driving method using TFTs (thin film transistors), a plurality of scan lines and a plurality of data lines, which are arranged in horizontal and vertical directions, respectively, and a plurality of pixel electrodes formed at intersections of the scan lines and the data lines are provided on a TFT array substrate. In addition, on the TFT array substrate may be provided various peripheral circuits having TFTs as their elements, including a sampling circuit, a pre charge circuit, a scan line driving circuit, a data line driving circuit, and a test circuit, etc. If liquid crystal panels or liquid crystal modules including liquid crystal panels and peripheral circuits formed on the liquid crystal panels are equal in size, a larger image display region defined by the plurality of pixel electrodes arranged in the form of a matrix, that is, a larger region on the liquid crystal panel on which images are displayed depending on variation of alignment conditions of liquid crystal is more desirable as basically requested for a display. Accordingly, it is common that the peripheral circuits are provided in a narrow and long peripheral portion of the TFT array substrate around the image display region.

Of these peripheral circuits, the sampling circuit is a circuit for sampling an image signal having a high frequency so as to stably supply the image signal to the data lines at a predetermined timing in synchronization with scan signals. The sampling circuit requires sufficiently high current supply capability for TFTs as its main elements in order to exert its function as mentioned above. In addition, since current flowing through the TFTs composing the sampling circuit leaks out somewhat even in an off state under a specific voltage, channels of the TFTs must be long to some degree in order to suppress the leak current. Accordingly, the TFTs can not become small in size unconditionally. When there is a restriction on reduction of the channel length, channel widths of the TFTs have to be enlarged in order to realize the high current supply capability. Under such a constraint, conventionally, the sampling function is compatible with a layout in a narrow region by arranging sampling circuits around the image display region.

In addition, if the channel widths of the TFTs included in the sampling circuit increases, a distance at which image signal lines and data lines electrically connected to the TFTs increases. Accordingly, there arises a technical problem in that a size of capacitive coupling between these lines increase due to parasite capacitance between these lines and variation of potential on the image signal lines has an effect on potential on the data lines even when the TFTs of the sampling circuit are in an off state, consequently deteriorating image quality. More specifically, the enlargement of the channel widths of the TFTs may cause a so-called pushdown voltage effect that the potential of the data lines is turned to an image signal potential lower than an original image signal potential. As means to overcome such a technical problem, JP-A-2002-49357 and JP-A-2002-49331 disclose a technique for reducing parasite capacitance between the data lines and the image signal lines, which exists in the vicinity of switch circuits included in the sampling circuits.

However, in JP-A-2002-49357 and JP-A-2002-49331, each of the switch circuits is formed of one TFT, and, for example, a single channel TFT such as an n-channel TFT is in charge of maintenance of the image signal and record of the image signal on the data lines. With such a TFT, an amount of charges ejected from the TFT when the TFT is turned into an off state increases, thereby increasing pushdown voltages of the data lines. As a result, there arises a technical problem of deterioration of image quality due to a luminance difference between pixels electrically connected to the data lines. In addition, for example in an inverse-driven liquid crystal display device, record of the image signal at a positive electrode and record of the image signal at a negative electrode becomes asymmetrical due to the pushdown voltages, thereby causing an operational problem of malfunction such as burn-in of liquid crystal.

SUMMARY

An advantage of some aspects of the invention is that it provides a driving circuit of an electro-optical device, which is capable of improving image quality and reducing burn-in of an inverse-driven liquid crystal, or in, for example, the electro-optical device having the driving circuit, and an electronic apparatus including the electro-optical device.

The present invention provides a driving circuit of an electro-optical device for driving the electro-optical device including a plurality of scan lines, a plurality of data lines, and a plurality of pixel portions, all of which are arranged in an image display region on a substrate, the plurality of pixel portions being electrically connected respectively to the plurality of scan lines and the plurality of data lines, including a sample hold circuit including sampling switches for supplying an image signal supplied by an image signal line to the plurality of data lines according to first and second sampling signals, and a data line driving circuit for supplying the first and second sampling signals sequentially for each of the sampling switches. Each of the sampling switches includes a first transistor for sustaining the image signal according to the first sampling signal and a second transistor electrically connected in series to the first transistor for supplying the image signal sustained by the first transistor to the data lines according to the second sampling signal.

When the driving circuit of the present invention is driven, image signals are supplied to the image signal lines and the sample hold circuit. More specifically, for example, N serial-parallel converted image signals are supplied to N image signal lines and further the sample hold circuit from branch wire lines arranged in correspondence to the data lines. N image signals may be generated by converting a serial image signal into a plurality of parallel image signals of 3 phase, 6 phase, 12 phase, 24 phase, etc. by means of an external in order to display images with high precision while suppressing a driving frequency from being increased.

At the same time of supplying the image signals, the first sampling signal and the second sampling signal are sequentially supplied to the sampling switches. Then, the sample hold circuit supplies the image signals to the data lines sequentially according to the first sampling signal and the second sampling signal. Accordingly, the pixel portions electrically connected to the data lines are driven.

In the pixel portions, the image signals are supplied from the data lines to display elements by pixel switching elements for performing a switching operation according to scan signals supplied from a scan line driving circuit via scan lines. Accordingly, liquid crystal elements as the display elements display the images based on the supplied image signals.

However, when the above-mentioned driving is performed, under the condition that an image signal is supplied to one of the plurality of data lines, there may occur a potential difference between the one data line and a different data line driven next, depending on the contents of an image to be displayed.

More specifically, there exists parasite capacitance between two adjacent data lines of the plurality of data lines arranged in the image display region. For example, in a sampling switch corresponding to the two adjacent data lines having the parasite capacitance, a pushdown voltage may be produced as an image signal potential of a data line at a drain side of the sampling switch is changed by the parasite capacitance between the data line and an adjacent data line. This pushdown voltage may be produced by a current that must not be essentially supplied from the sampling switch. Such a pushdown voltage may be also produced by a leak current in a TFT constituting the sampling switch.

If no measure against the pushdown voltage is taken, there may occur luminance deviation at a boundary between groups of data lines in an image displayed in the image display region. A degree of luminance deviation depends on contents of an image to be displayed or a N image signal potential difference between adjacent data lines. In addition, when a pre charge operation is performed, the degree of luminance deviation depends on a relative relationship between a pre charge level and an image signal potential. In addition, in an inverse-driven display element such as liquid crystal, the inverse driving becomes asymmetrical due to the pushdown voltage, which results in burn-in of the display element.

To overcome such a problem, the sample hold circuit included in the driving circuit of the electro-optical device of the present invention includes the sampling switches, each of which has the first and second transistors.

More specifically, in each of the sampling switches, for example, as a source side of the first transistor is electrically connected to the image signal line and a drain side of the first transistor is electrically connected to a source side of the second transistor, the first and second transistors are electrically connected in series. As the on state and off state of the first and second transistors are switched according to the first sampling signal and the second sampling signal, the image signal is finally recorded on the data line. Each of the first and second transistors may be a single channel TFT and is switched from the off state to the on state when the first and second sampling signals are supplied to the gates thereof, respectively. The first transistor has sustenance capability to sustain the image signal supplied to the sampling switch through the image signal line, for example, which is higher than that of the second transistor. In other words, the first transistor has a leak current less than that of the second transistor and can reduce the pushdown voltage caused by the leak current. Here, for example, when the first transistor has an element structure giving priority to the sustenance capability of the image signal, the second transistor has an element structure giving priority to record capability of the image signal, as compared to the first transistor. Accordingly, by imposing a shortage of the record capability of the first transistor on the second transistor, it is possible to secure sufficient record capability of the image signal on the data line while reducing the pushdown voltage, when the sampling switches 202 are used as a whole.

As described above, different pushdown voltages of the data lines can be reduced by reducing the pushdown voltages, thus reducing a difference of periodical image signal record on the data lines. Accordingly, it is possible to prevent occurrence of luminance deviation visible on a display screen. As a result, the electro-optical device can display images having high quality. In addition, asymmetry of image signals due to the pushdown voltage in the electro-optical device, such as an inverse-driven liquid crystal display device, can be alleviated by reducing the pushdown voltage, thus reducing burn-in of liquid crystal.

In one aspect of the driving circuit of the electro-optical device of the present invention, a gate length of the first transistor is longer than that of the second transistor.

According to this aspect, the leak current in the off state can be reduced by increasing the gate length of the first transistor by more than the gate length of the second transistor.

The second transistor electrically connected to the data line is designed to have the gate length shorter than that of the first transistor when viewed from the first transistor side. Accordingly, the second transistor has supply capability to supply the image signal to the data line, which is higher than that of the first transistor. In this way, by constructing the sampling switch using the first transistor having high sustenance capability of the image signal and the second transistor having high supply capability of the image signal, the pushdown voltage can be reduced without deteriorating the supply capability of the image signal, as compared to a case that the image signal is supplied to the data line using a sampling switch formed by a single transistor.

More specifically, charges emitted from the first transistor when the first transistor turns into the off state increase as the gate length of the first transistor increase. Accordingly, by connecting the second transistor to the drain side of the first transistor, it is possible to reduce the off current flowing through a data line when the first transistor turns into the off state, which results in reduction of the pushdown voltage in the data line. For example, since the off current flowing into the data line can be reduced to a fraction of the off current, as compared to the conventional sampling switch constituted by one transistor, it is possible to reduce burn-in of liquid crystal and luminance deviation, which are caused by the pushdown voltage.

In addition, since it is preferable to form the first and second transistors TFTs having different gate lengths, there is no need to perform a separate process of forming these two transistors. Accordingly, the driving circuit of the electro-optical device of the present invention has excellent performance as compared to a conventional driving circuit without increasing the number of manufacturing processes.

In another aspect of the driving circuit of the electro-optical device of the present invention, a gate width of the first transistor is larger than that of the second transistor.

According to this aspect, the leak current in the off state can be reduced and supply capability of current according to the image signal in the on state can be secured.

In yet another aspect of the driving circuit of the electro-optical device of the present invention, the first transistor has an LDD (Lightly Doped Drain) structure.

According to this aspect, when the first transistor turns into the on state, the off current flowing into the first transistor can be reduced while suppressing the on current flowing into the first transistor from being reduced. Accordingly, by adopting the LDD structure, the first transistor can make its high on current compatible with its low off current effectively.

In yet another aspect of the driving circuit of the electro-optical device of the present invention, a first switching timing at which the first transistor is switched from an on state to an off state is concurrent with or later than a second switching timing at which the second transistor is switched from an on state to an off state.

According to this aspect, since the first switching timing is concurrent with or later than the second switching timing, the off current flowing into the first transistor in the off state can be prevented from flowing into the data line via the second transistor. More specifically, charges emitted from the sampling switch to the data line when the sampling switch turns into the off state depends on the product of the gate length and the gate width of the second transistor arranged close to the data line. Accordingly, it is possible to obtain a remarkable effect that charges emitted to the data line can be reduced as compared to the charges emitted when the first transistor turns into the off state, and the pushdown voltage caused by the charges can be reduced. In addition, such an effect may be achieved even when the first and second switching timings are concurrent.

In yet another aspect of the driving circuit of the electro-optical device of the present invention, each of the sampling switches includes an additional capacitor to make a potential difference between a drain of the first transistor and a source of the second transistor small.

According to this aspect, the push down voltage between the first and second transistors can be reduced, and charges emitted from the first transistor when the first transistor turns into the off state can be suppressed from having an effect on the second transistor having low sustenance capability.

In this aspect, the additional capacitor includes an upper capacitive electrode electrically connected to the drain of the first transistor and the source of the second transistor, a lower capacitive electrode electrically connected to one electrode of one of the plurality of pixel portions, the one electrode forming a storage capacitor, and an insulating film interposed between the upper capacitive electrode and the lower capacitive electrode.

With this configuration, for example, the lower capacitive electrode is electrically connected to a common electrode forming the storage capacitor provided in the pixel portion of the liquid crystal display device, and the additional capacitor can be formed by the upper capacitive electrode, the lower capacitive electrode, and the insulating film interposed between these electrodes. The area of the upper capacitive electrode and lower capacitive electrode may be set so that capacitance of the additional capacitor is ten times or more greater than the gate capacitance of the first transistor, for example. Such an additional capacitor can make a difference between a potential at the drain of the first transistor and a potential at the source of the second transistor small, and, according to this small potential difference, it is possible to reduce the pushdown voltage produced in a wire line between the first transistor and the second transistor.

To achieve the above advantages, the present invention provides an electro-optical device including the above-described driving circuit.

According to the electro-optical device of the present invention, like the driving circuit, a difference between different pushdown voltages of the data lines can be reduced by reducing the pushdown voltages, thus reducing uneven record of periodical image signals on the data lines. Accordingly, it is possible to prevent occurrence of luminance deviation visible on a display screen. As a result, the electro-optical device can display images with high quality. In addition, asymmetry of image signals due to the pushdown voltage in the electro-optical device, such as an inverse-driven liquid crystal display device, can be alleviated by reducing the pushdown voltage, thus reducing burn-in of liquid crystal.

In addition, to achieve the above advantages, the present invention provides an electronic apparatus including the above-described electro-optical device.

Since the electronic apparatus of the present invention includes the above-described electro-optical device, it is possible to realize various electronic apparatuses, which are capable of displaying images having high quality, including projection-type display devices, televisions, mobile telephones, electronic pocket books, word processors, view finder type or monitor direct-view type video tape recorders, workstations, video conference telephones, POS terminals, apparatuses equipped with touch panels, etc. In addition, it is also possible to realize electrophoretic devices such as electronic paper, electron emission devices (field emission displays, surface-conduction electron-emitter displays, etc), DLP (digital light processing) using the electrophoretic devices and the electron emission devices, etc.

These and other operations and advantages of the present invention will be more apparent from the detailed description of the following embodiments.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in accordance with embodiments of the invention, a driving circuit of an electro-optical device, an electro-optical device having the driving circuit, and an electronic apparatus will be described with reference to the accompanying drawings. In these embodiments, the electro-optical device is applied to a liquid crystal display device.

Overall Configuration of Electro-Optical Panel

Figure 1:
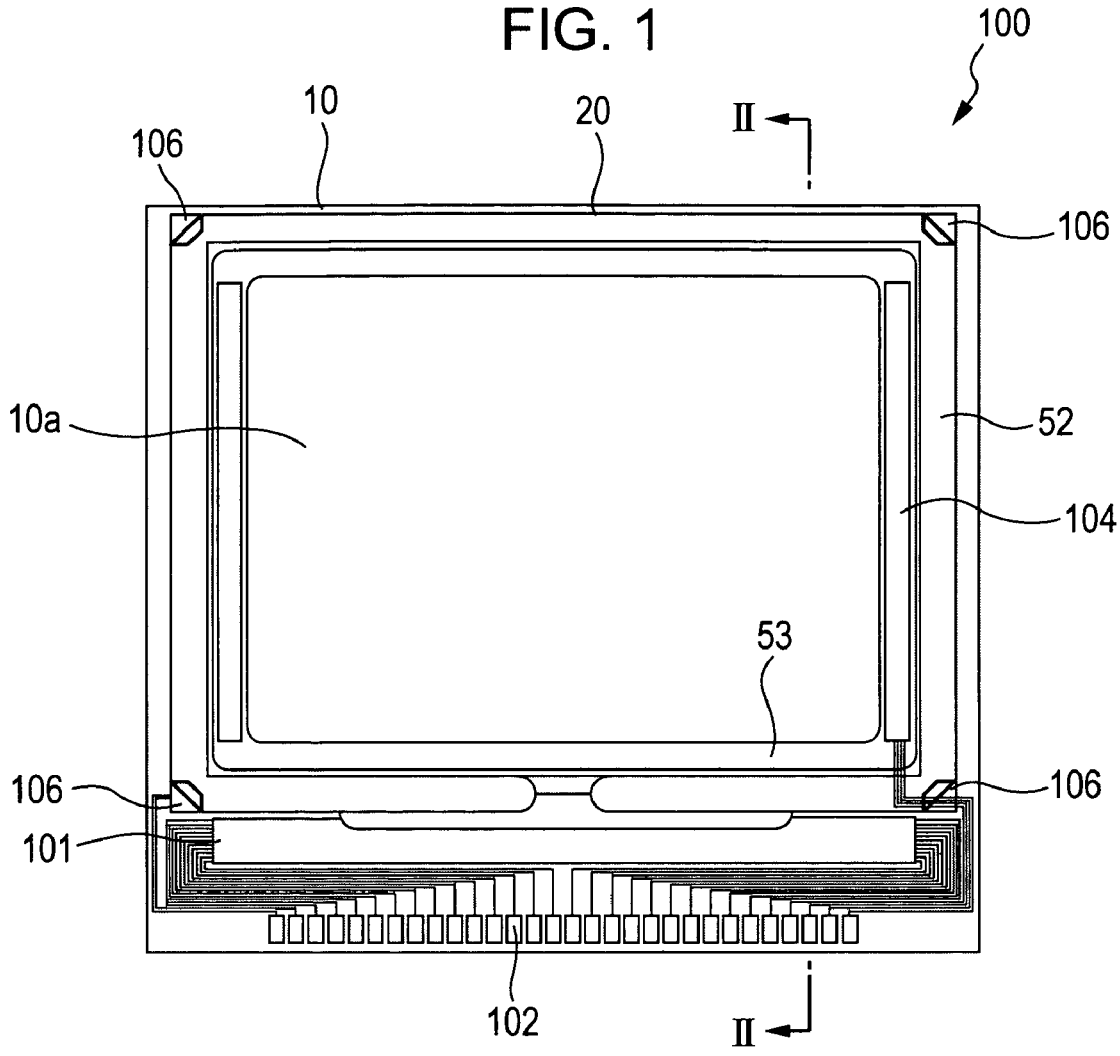
FIG. 1 is a plan view illustrating an overall configuration of a liquid crystal display device according to an embodiment of the present invention.
Figure 2:
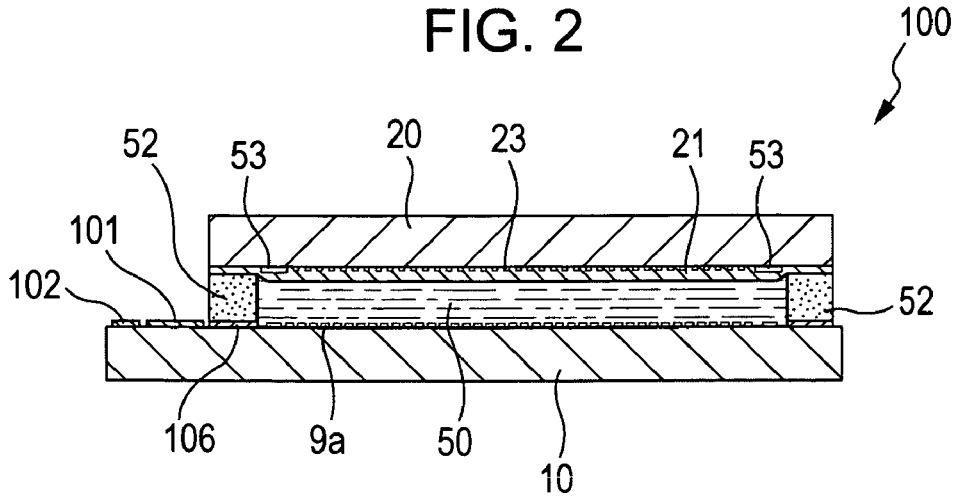
FIG. 2 is a sectional view taken along the line II-II of FIG. 1.

First, in a liquid crystal display device as an example of an electro-optical device of the present invention, an overall configuration of a liquid crystal panel as an example of an electro-optical panel will be described with reference to FIGS. 1 and 2. FIG. 1 is a schematic plan view of a liquid crystal panel when a TFT array substrate and elements formed thereon are viewed from a counter substrate, and FIG. 2 is a sectional view taken along the line II-II of FIG. 1. In the following description, an active matrix-driven liquid crystal display device with a built-in driving circuit will be described as an example.

In FIGS. 1 and 2, a liquid crystal panel 100 according to an embodiment of the present invention includes a TFT array substrate 10 and a counter substrate 20 opposite to the TFT array substrate 10. A liquid crystal layer 50 is interposed between the TFT array substrate 10 and the counter substrate 20. The TFT array substrate 10 and the counter substrate 20 are bonded to each other by a sealing material 52 provided in a sealing region around an image display region 10*a*.

The sealing member 52 is made of an ultraviolet-curing resin or a thermo-setting resin to joint both substrate together, for example. In a manufacturing process, the sealing member 52 is cured by ultraviolet irradiation, heating, etc. after it is applied on the TFT array substrate 10. In the sealing member 52, gap materials, such as glass fibers or glass beads for defining a gap between the TFT array substrate 10 and the counter substrate 20 (a substrate-between gap) as a specified value, are scattered.

A frame light shielding film 53 defining a frame region of the image display region 10*a* is provided on the counter substrate 20 in parallel to an inner side of the sealing region in which the sealing member 52 is arranged. However, some or all of the frame light shielding film 53 may be provided as a built-in light shielding film on the TFT array substrate 10.

Of the peripheral region around the image display region 10*a*, a data line driving circuit 101 and external circuit connecting terminals 102 are provided along a lower side of the TFT array substrate 10 in a region outside the sealing region in which the sealing member 52. In addition, a scan line driving circuit 104 is provided to be covered with the frame light shielding film 53 along one of two left and right sides adjacent to the lower side of the TFT array substrate 10. In addition, the scan line driving circuit 104 may be provided along the two left and right sides adjacent to the lower side of the TFT array substrate 10 along which the data line driving circuit 101 and the external circuit connecting terminals 102 are provided. In this case, two scan line driving circuits 104 are interconnected by a plurality of wires provided along the remaining side, i.e., upper side, of the TFT array substrate 10.

At four corners of the counter substrate 20 are arranged lower and upper conducting members 106 which serve as conducting terminals between the lower and upper substrate. On the other hand, on the TFT array substrate 10, other conducting terminals are provided in a region opposite to these corners. The conducting terminals and the conducting members 106 make electrically conduct the TFT array substrate 10 and the counter substrate 20.

In FIG. 2, on the TFT array substrate 10, an alignment film is formed on pixel electrodes 9*a* formed after TFTs for pixel switches and wires such as the scan lines, the data lines and so on are formed. On the other hand, a counter electrode 21, a lattice or stripe-shaped light shielding film 23, and an alignment are sequentially formed on the counter substrate 20. The liquid crystal layer 50 is formed of a specific kind of nematic liquid crystal or a mixture of some kinds of nematic liquid crystal and the liquid crystal is aligned in a predetermined arrangement between the pair of alignment films.

Further, although not shown in FIGS. 1 and 2, in addition to the data line driving circuit 101 and the scan line driving circuit 104, a sample hold circuit for sampling an image signal on an image signal line and supplying the sampled image signal to the data lines and a pre charge circuit for supplying a pre charge signal having a predetermined voltage level to the data lines prior to the image signal, each of which will be described later, are formed on the TFT array substrate 10. In this embodiment, preferably, a test circuit for checking quality, faults, etc. of the electro-optical device during manufacturing and shipping may be formed in addition to the sample hold circuit and the pre charge circuit.

Overall Configuration of Electro-Optical Device

Figure 3:
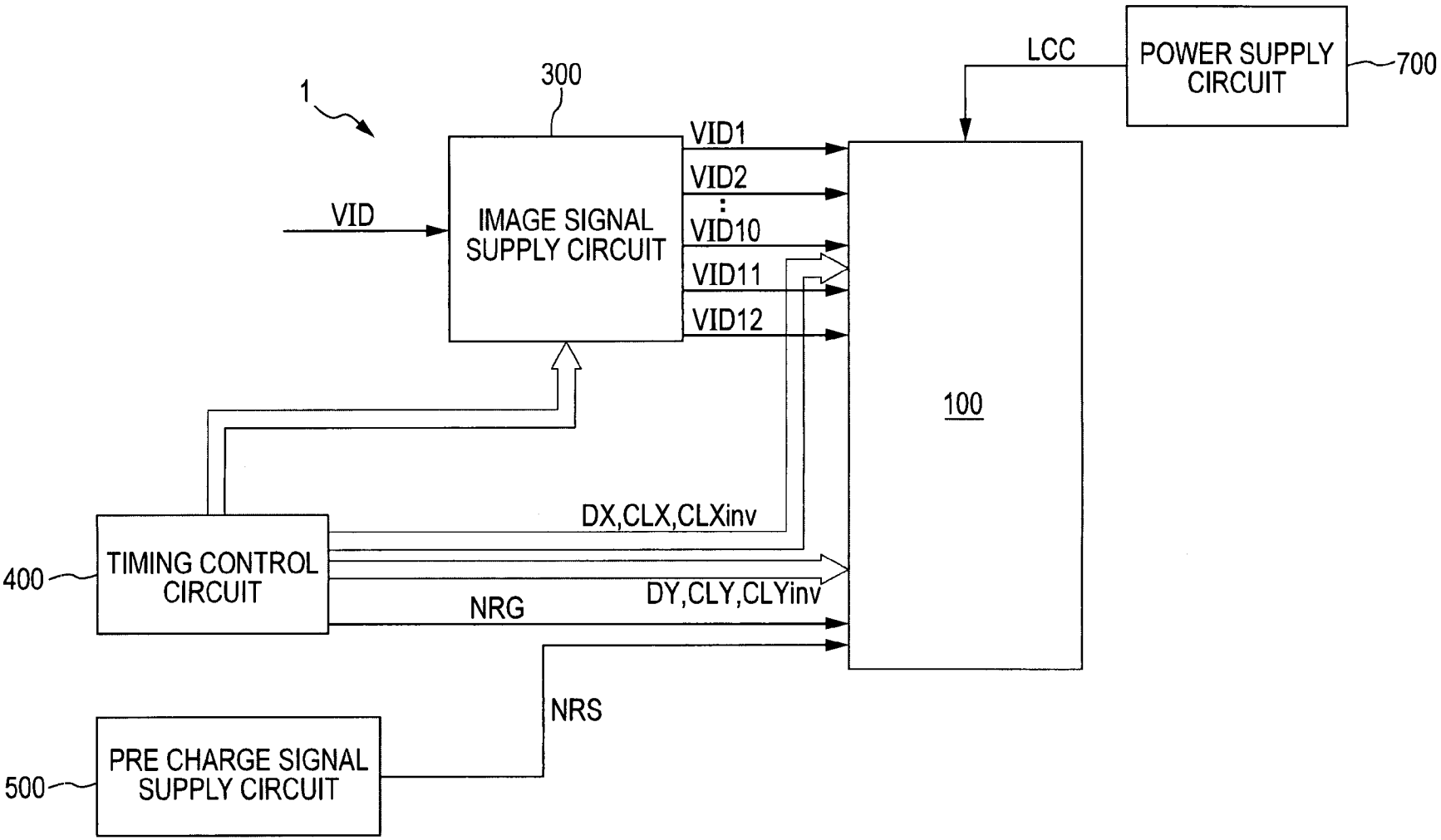
FIG. 3 is a block diagram illustrating an overall configuration of a liquid crystal display device according to an embodiment of the present invention.
Figure 4:
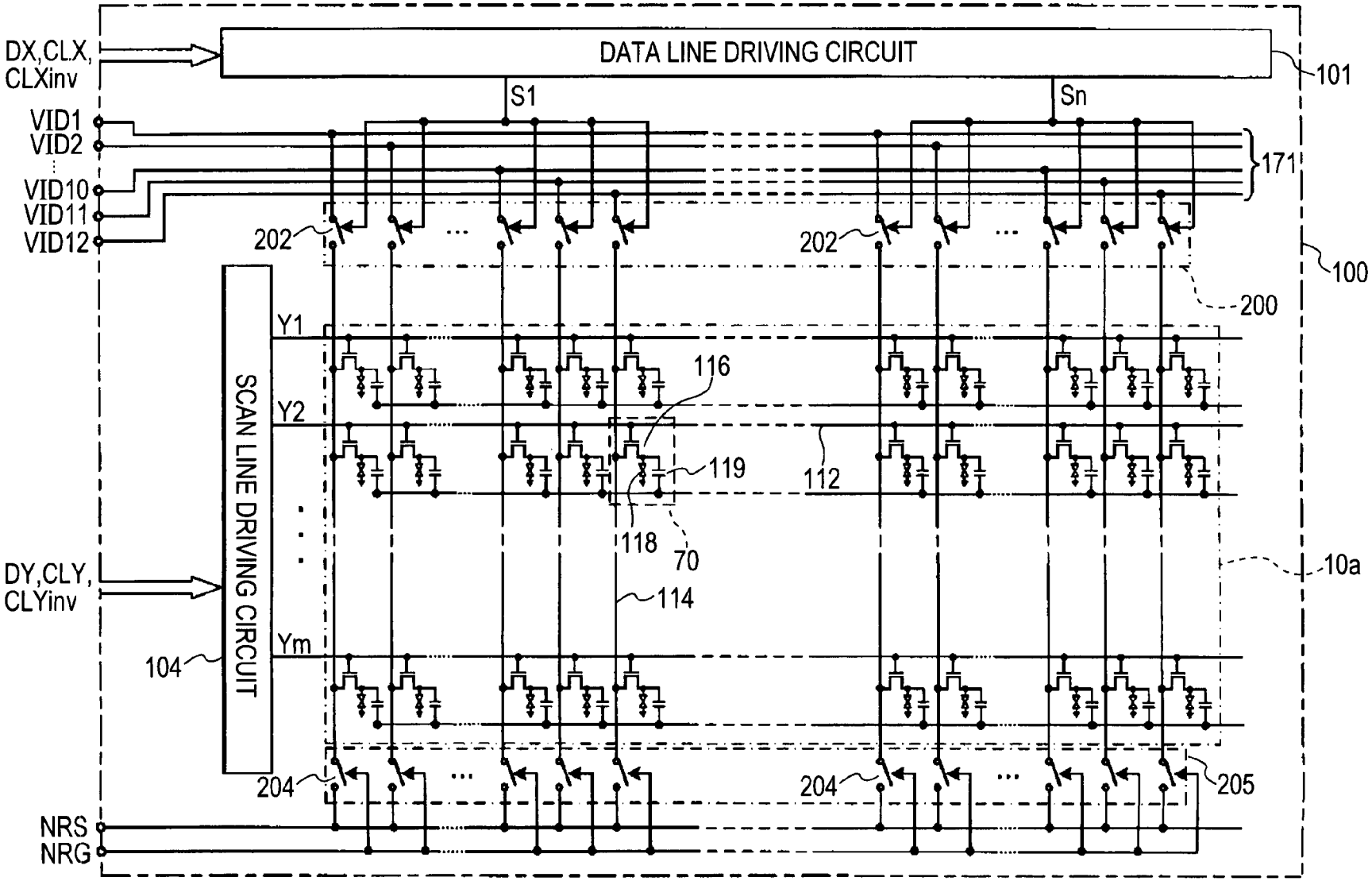
FIG. 4 is a block diagram illustrating an electrical configuration of a liquid crystal panel according to an embodiment of the present invention.

Next, an overall configuration of a liquid crystal display device 1 which is an exemplary of the electro-optical device of the present invention will be described with reference to FIGS. 3 and 4. FIG. 3 is a block diagram illustrating an overall configuration of the liquid crystal display device 1 and FIG. 4 is a block diagram illustrating an electrical configuration of the liquid crystal panel 100.

As shown in FIG. 3, the liquid crystal display device 1 includes the liquid crystal panel 100, an image signal supply circuit 300, a timing control circuit 400, a pre charge signal supply circuit 500, and a power supply circuit 700, which are provided as external circuits.

The timing control circuit 400 is configured to output various timing signals to be used in various components. Timing signal output means as a part of the timing control circuit 400 prepares a dot clock, which is a clock of the minimal unit, for scanning pixels. Based on the prepared dot clock, the timing control circuit 400 generates a Y clock signal CLY, an inverted Y clock signal CLYinv, an X clock signal CLX, an inverted X clock signal CLXinv, a Y start pulse DY, and an X start pulse DX. In addition, the timing control circuit 400 generates a pre charge select signal NRG.

A series of input image data VID is inputted from the outside to the image signal supply circuit 300. The image signal supply circuit 300 performs a serial-parallel conversion for the series of input image data VID and generates N-phase image signals, for example, 12-phase image signals VID1 to VID12 in this embodiment. Alternatively, the image signal supply circuit 300, each of the polarities of voltages of the image signals VID1 to VID12 may be inverted into a positive or negative polarity with respect to a reference potential and output the polarity-inverted image signals VID1 to VID12.

The pre charge signal supply circuit 500 matches a polarity of a voltage of a pre charge signal NRS to the polarities of the voltages of the image signals VIDk (where, k=1, 2, . . . , 12), inverts into positive or negative polarity with respect to a reference potential in correspondence and supplies the polarity-inverted pre charge signal NRS.

The power supply circuit 700 supplies common power of a predetermined common potential LCC to the counter electrode 21 shown in FIG. 2. In this embodiment, the counter electrode 21 is formed in a lower side of the counter substrate 20 shown in FIG. 2 so as to be opposite to the plurality of pixel electrodes 9*a*.

Next, an electrical configuration of the liquid crystal panel 100 will be described.

As shown in FIG. 4, the liquid crystal panel 100 includes the scan line driving circuit 104, the data line driving circuit 101, a sample hold circuit 200, and a pre charge circuit 205, which composes an exemplary driving circuit of the electro-optical device of the present invention, in a peripheral region of the TFT array substrate 10.

The scan line driving circuit 104 is supplied with the Y clock signal CLY, the inverted Y clock signal CLYinv, and the Y start pulse DY. When the Y start pulse DY is inputted to the scan line driving circuit 104, the scan line driving circuit 104 sequentially generates and outputs scan signals Y1, . . . , Ym at a timing based on the Y clock signal CLY and the inverted Y clock signal CLYinv.

The data line driving circuit 101 is supplied with the X clock signal CLX, the inverted X clock signal CLXinv, and the X start pulse DX. When the X start pulse DX is inputted to the data line driving circuit 101, the data line driving circuit 101 sequentially generates and outputs sampling signals S1, . . . , Sn at a timing based on the X clock signal CLX and the inverted X clock signal CLXinv.

The sample hold circuit 200 includes a plurality of sampling switches 202 for each data line. As will be described later, each of the sampling switches 202 is formed by two single P-channel or N-channel TFTs electrically connected in series. The pre charge circuit 205 includes a plurality of pre charge switches 204, each of which is formed by a single P-channel or N-channel or a complementary TFT. As shown in FIG. 4, one end of each data line 114 is connected to a corresponding sampling switch 202 while the other end of each data line 114 is connected to a corresponding pre charge switch 204.

In addition, the liquid crystal panel 100 includes the data lines 114 and scan lines 112, which are arranged in horizontal and vertical directions, respectively, on the image display region occupying the central portion of the TFT array substrate 10, and pixel portions 70 formed at intersections of the data lines 114 and the scan lines 112. Each pixel portion 70 includes a pixel electrode 9*a* of a liquid crystal element 118 arranged in the form of a matrix, a TFT 116 for controlling switching of the pixel electrode 9*a*, and a storage capacitor 119. In addition, in this embodiment, in particular, the total number of scan lines 112 is m (where, m is a natural number more than 2) and the total number of data lines 114 is n (where, n is a natural number more than 2).

The image signals VID1 to VID12 expanded into 12 phases according to the above-mentioned serial-parallel conversion are supplied to the liquid crystal panel 100 via N image signal lines 171, for example, 12 image signal lines 171 in this embodiment. As will be described below, n data lines 114 are sequentially driven for each group of data lines, which consists of 12 data lines 114 corresponding to the number of image signal lines 171.

The sampling signals Si (where, i=1, 2, . . . , n) are sequentially supplied from the data line driving circuit 101 for each of the sampling switches 202 corresponding to the group of data lines, and each sampling switch 202 is switched between an on state and an off state according to the sampling signals Si. As will be described later, each sampling switch 202 is connected to a corresponding image signal line 171 by a branch wiring line. The image signals VID1 to VID12 from 12 image signal lines 171 are simultaneously supplied to the data lines 114 belonging to a group of data lines and are sequentially supplied to groups of data lines by the sampling switches 202 turned into the on state. Accordingly, the data lines 114 belonging to one group of data lines are simultaneously driven. As a result, in this embodiment, a driving frequency can be suppressed in order to drive n data lines 114 for each group of data lines.

In pre charge circuit 205, the pre charge switches 204 are input with the pre charge select signal NRG generated by the timing control circuit 400 and the pre charge signal NRS supplied from the pre charge signal supply circuit 500. Prior to supply of the sampling signals Si for the sampling switches 202, the pre charge select signal NRG is simultaneously supplied to the pre charge switch 204, so that the pre charge switch is simultaneously turned on. In addition, the pre charge signal NRS is supplied to a corresponding data line 114 by a pre charge switch 204. In this manner, as the data lines 114 are pre charged to a certain potential prior to a timing at which the image signal VIDk are supplied, it is possible to record the image signal VIDk on the data lines 114 in a relatively short time. In addition, a sampling signal Si is a signal including two sampling signals Sai and Sbi, which will be described later.

Considering configuration of one pixel portion 70 in FIG. 4, a data line 114 to which an image signal VIDk (where, k=1, 2, 3, . . . , 12) is supplied is electrically connected to a source electrode of a TFT 116, a scan line 112 to which a scan signal Yj (where, j=1, 2, 3, . . . , m) is supplied is electrically connected to a gate electrode of the TFT 116, and a pixel electrode 9*a* of a liquid crystal element 118 is connected to a drain electrode of the TFT 116. Here, in the pixel portion 70, the liquid crystal element 118 is formed of liquid crystal interposed between the pixel electrode 9*a* and the counter electrode 21. Accordingly, the pixel portions 70 are formed in the form of a matrix at intersections of the scan lines 112 and the data lines 114.

The scan lines 112 are line-sequentially selected by the scan signals Y1, . . . , Ym outputted from the scan line driving circuit 104. In a pixel portion 70 corresponding to a selected scan line 112, when a scan signal Yj is supplied to a TFT 116, the TFT 116 turns into the on state and the pixel portion 70 turns into a select state. By switching off the TFT 116 for a specified period of time, the image signal VIDk is supplied from the data line 114 to the pixel electrode 9*a* of the liquid crystal element 118 at a predetermined timing. Accordingly, the liquid crystal element 118 is applied with an application voltage defined by a potential of the pixel electrode 9*a* and a potential of the counter electrode 21. Light is modulated to represent gray scales by changing orientation or order of molecules in liquid crystal depending on a level of applied voltage. In a normally-white mode, transmittance of incident light decreases according to an applied voltage in each unit pixel. On the contrary, in a normally-black mode, transmittance of incident light increases according to an applied voltage in each unit pixel. Accordingly, as a whole, light with a contrast according to the image signals VID1 to VID12 is emitted from the liquid crystal panel 110.

Here, the storage capacitor 119 is connected in parallel to the liquid crystal element 118 in order to prevent a maintained image signal from being leaked out. For example, since a voltage of the pixel electrode 9*a* is sustained by the storage capacitor 119 by a three-digit longer than a period of time for which a source voltage is applied, a sustenance characteristic is improved, which results in realization of a high contrast.

Figure 5:
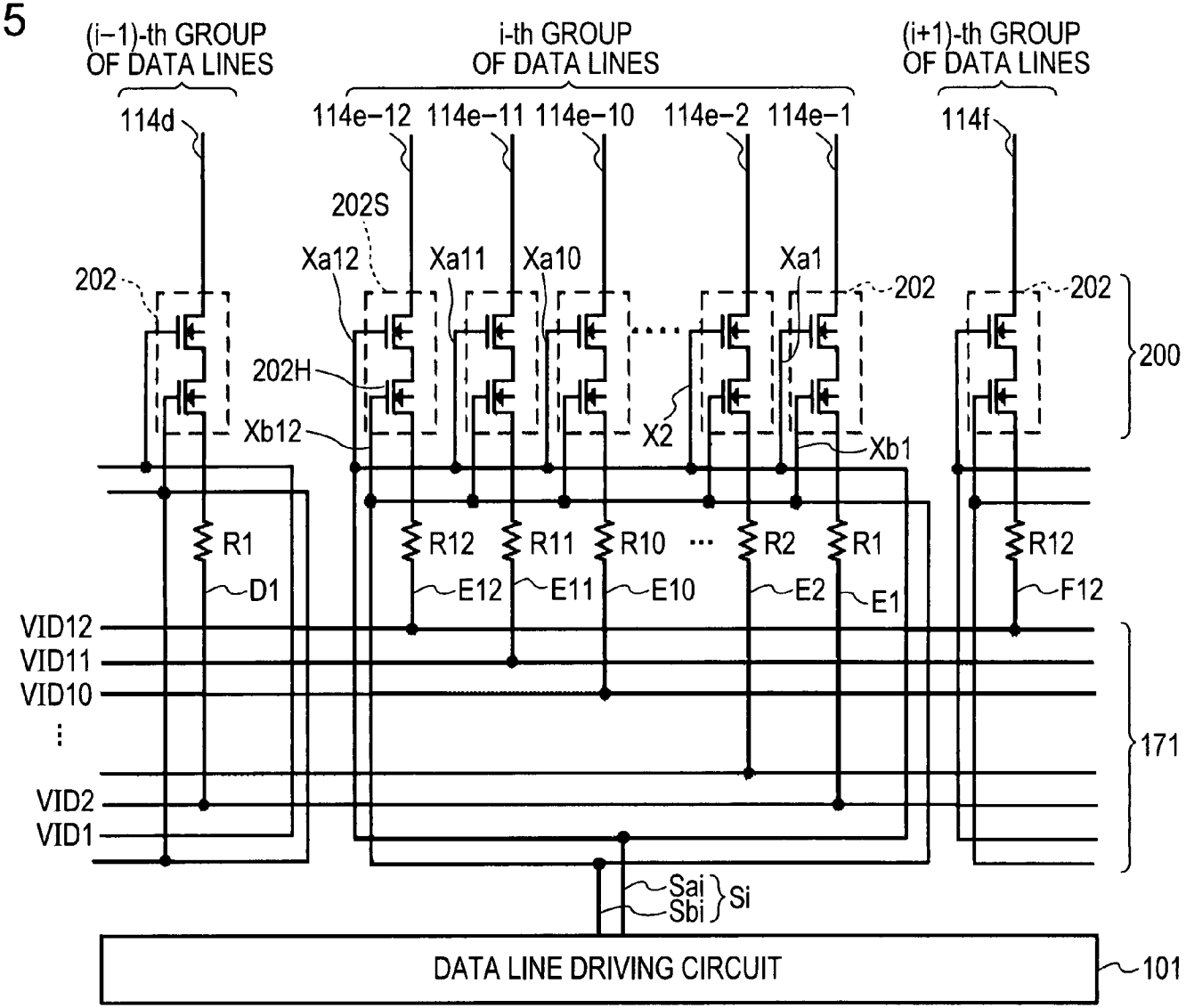
FIG. 5 is a diagram illustrating a circuit configuration according to driving of data lines according to an embodiment of the present invention.
Figure 6:
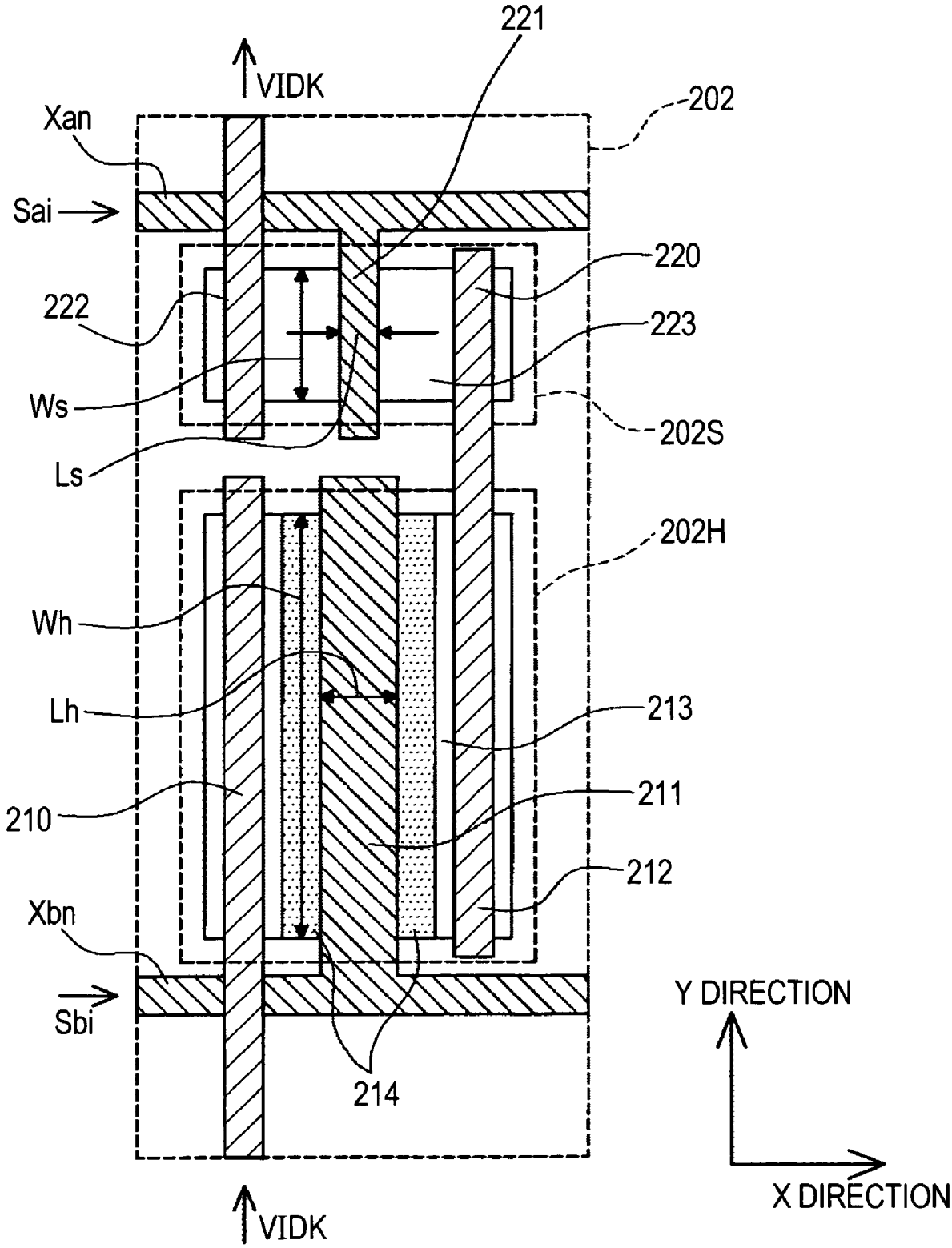
FIG. 6 is a plan view illustrating a detailed configuration of a sampling switch according to an embodiment of the present invention.
Figure 7:
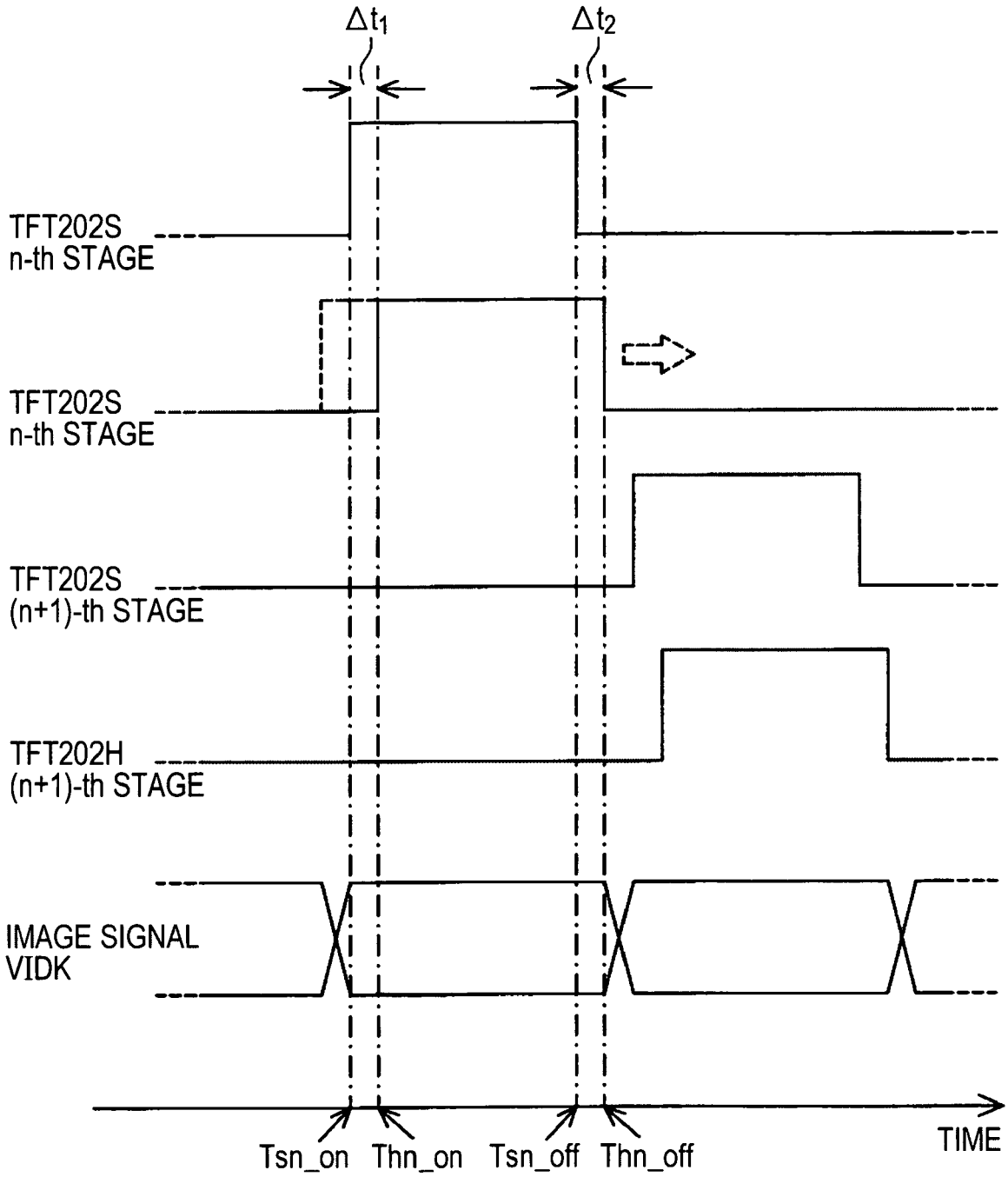
FIG. 7 is a timing chart of first and second sampling signals supplied to a sampling switch according to an embodiment of the present invention.

Main Circuit Configuration Related to Driving of Data Lines and Operation Thereof Next, the main circuit configuration related to driving of the data lines 114 and operation thereof will be described with reference to FIGS. 5 to 7. FIG. 5 is a diagram illustrating a circuit configuration according to driving of the data lines 114. FIG. 6 is a plan view illustrating a detailed configuration of the sampling switch 202. FIG. 7 is a timing chart of sampling signals supplied to the sampling switch 202. For the sake of convenience of explanation, FIG. 5 shows a vertical reversion of the data line driving circuit and sample hold circuit shown in FIG. 4.

Hereinafter, a main configuration related to driving of the data lines 114 when n data lines 114 are sequentially driven in one direction along a direction of arrangement of the n data lines 114 for each group of data lines, will be described considering configuration of three groups of data lines driven based on three (i−1)-th, i-th and (i+1)th sampling signals Si−1, Si and Si+1 output from the data line driving circuit 101, in particular, configuration of an i-th group of data lines driven on the basis of the i-th sampling signal Si.

Main Circuit Configuration Related to Driving of Data Lines

In FIG. 5, 12 branch wire lines E1 to E12 are arranged so as to correspond to arrangement of data lines 114*e* (114*e*-1 to 114*e*-12) belonging to the i-th group of data lines. One ends of 12 branch wire lines E1 to E12 are electrically connected to the image signal lines 171, respectively, while the other ends of these 12 branch wire lines E1 to E12 are electrically connected to data lines 114*e*-*k* by the sampling switches 202, respectively.

Each sampling switch 202 is configured to include a TFT 202H that is an example of a first transistor of the present invention and a TFT 202S that is an example of a second transistor of the present invention. As a drain side of the TFT 202H is electrically connected to a source side of the TFT 202S, the TFTs 202H and 202S are electrically connected in series. A source of the TFT 202H is connected to a branch wire line Ek and a drain of the TFT 202S is electrically connected to a data line 114*e*-*k*. A gate of the TFT 202S is electrically connected to the data line driving circuit 101 by a control wire line Xa1 to Xa12 and a gate of the TFT 202H is electrically connected to the data line driving circuit 101 via a control wire line Xb1 to Xb12. In addition, a first sampling signal Sbi and a second sampling signal Sai included in the i-th sampling signal Si are supplied from the data line driving circuit 101 to each of the control wire line Xa1 to Xa12 and the control wire line Xb1 to Xb12. The TFTs 202H and 202S are single channel-typed TFTs, for example, and are switched from an off state to an on state when a certain sampling signal is supplied to the gates thereof.

More specifically, the TFT 202H is switched from the off state to the on state by applying the first sampling signal Sbi included in the sampling signal Si to the gate, so that an on current according to the image signal VIDk flows into the TFT 202H. For example, if the first sampling signal Sbi is a binary signal defined by two high and low potentials, when a high level signal is applied to the gate electrode of the TFT 202H, the TFT 202H is switched from the off state to the on state. Subsequently, when a low level signal is applied to the gate electrode of the TFT 202H, the TFT 202H is switched from the on state to the off state, thereby sustaining the image signal VIDk. That is, the TFT 202H first holds the image signal before the image signal is supplied to the data line 114. Here, the TFT 202H has sustenance capability to sustain the image signal VIDk supplied to the sampling switch 202 by the image signal line 171, as will be described later, which is higher than that of the TFT 202S, while an off current flowing into the TFT 202H in the off state is lower than that flowing into the TFT 202S in the off state.

The TFT 202S has an element structure giving priority to record capability of the image signal on the data line 114, as compared to the TFT 202H. Since the TFT 202H has an element structure giving priority to sustenance capability of the image signal, it has insufficient record capability of the image signal on the data line 114. Accordingly, by imposing shortage of the record capability of the TFT 202H on the TFT 202S electrically connected between the TFT 202H and the data line 114, it is possible to secure sufficient record capability of the image signal on the data line 114 while reducing a pushdown voltage caused by a leak current flowing through the data line 114, in the entire sampling switches 202.

Detailed Configuration of Sampling Switch

Next, a detailed configuration of the sampling switch 202 will be described with reference to FIG. 6.

As shown in FIG. 6, the sampling switch 202 includes the TFTs 202S and 202H.

The TFT 202H includes a semiconductor layer 213, a source electrode 210 and a drain electrode 212 electrically connected to a source region and a drain region of the semiconductor layer 213, respectively, by a contact hole (not shown), and a gate electrode 211 formed above a channel region of the semiconductor layer 213.

The gate electrode 211 is an electrode portion branched out of the control wire line Xbi (where, i=1, 2, . . . 12) for supplying the first sampling signal Sbi to switch on/off the TFT 202H to the TFT 202H, and is formed of a polysilicon film, for example. The source electrode 210 and the drain electrode 212 are electrically connected to the source region and the drain region of the semiconductor layer 213, respectively, by the contact hole formed by removing a portion of a gate insulating film (not shown).

Since the TFT 202H has an LDD (Lightly Doped Drain) structure, it can make its high on current compatible with its low off current effectively. More specifically, an LDD region 214 is provided at both sides of the gate electrode 212 in the semiconductor layer 213 when viewed from top, and is formed by doping impurities into the semiconductor layer 213 in a self-alignment manner, using the gate electrode 211 formed on the semiconductor layer 213 as a mask. In the LDD region 214, it is possible to reduce the leak current when the TFT 202H turns into the off state, i.e., the off current, while it is possible to make the on current according to the image signal VIDk sufficiently flow into the TFT 202H sufficiently in the on state.

The TFT 202S includes a semiconductor layer 223, a source electrode 220 and a drain electrode 222 electrically connected to a source region and a drain region of the semiconductor layer 223, respectively, by a contact hole (not shown), and a gate electrode 221 formed above a channel region of the semiconductor layer 223.

The gate electrode 221 is an electrode portion branched out of the control wire line Xai (where, i=1, 2, . . . , 12) for supplying the second sampling signal Sai so as to switch on/off the TFT 202S to the TFT 202S, and is formed of a polysilicon film, for example. The source electrode 220 and the drain electrode 222 are electrically connected to the source region and the drain region of the semiconductor layer 223, respectively, by the contact hole formed by removing a portion of a gate insulating film (not shown).

Now, an element structure of the TFT 202H will be compared with that of the TFT 202S in detail. In FIG. 6, length of the gate electrode 211 in an X direction in the figure, i.e., a gate length Lh of the TFT 202H, is larger than a gate length Ls of the gate electrode 221. In addition, a width of the gate electrode 211 in a Y direction, i.e., a gate width Wh, is larger than a gate width Ws of the gate electrode 221. Accordingly, the TFT 202S has the record capability to supply the image signal VIDk to the data line 114, which is higher than that of the TFT 202H. On the other hand, since the gate length Lh and the gate width Wh of the TFT 202H are larger than the gate length Ls and the gate width Ws of the TFT 202S, the TFT 202H is superior in the sustenance capability of the image signal to the TFT 202S. Thus, when the TFT 202H having excellent sustenance capability of the image signal VIDk and the TFT 202S having excellent record capability are connected to each other in series, it is possible to obtain a remarkable effect of reducing the pushdown voltage by suppressing the leak current in the off state without deteriorating the record capability of the image signal, as compared to a case in which the image signal is supplied to the data line using a sampling switch formed by one TFT.

More specifically, charges emitted from the TFT 202H when the TFT 202H turns into the off state increase as the product of the gate length Lh and the gate width Wh of the TFT 202H becomes large. Accordingly, by connecting the TFT 202S to a drain side of the TFT 202H and turning the TFT 202S into the off state in advance when the TFT 202H turns into the off state, it is possible to reduce the off current of the TFT 202H flowing through the data line 114, which results in reduction of the pushdown voltage in the data line 114. For example, since the sampling switch 202 allows the off current flowing into the data line 114 to be reduced to a fraction of the off current, as compared to the conventional sampling switch constituted by one TFT, it is possible to reduce burn-in of liquid crystal and luminance deviation of pixel portions, which are caused by the pushdown voltage.

Thus, since the sampling switch 202 allows reduction of the leak current in the off state and allows the current according to the image signal to be sufficiently supplied to the data line 114, it is possible to display images of high quality with reduction of the luminance deviation caused by the pushdown voltage on liquid crystal display device. In addition, since the pushdown voltage is reduced, burn-in of inverse-driven liquid crystal display devices can be reduced, which results in extension of device life.

In addition, since it is preferable to form TFTs having different gate lengths and different gate widths, such as the TFT 202H and the TFT 202S, on an element substrate, there is no need to newly add a separate process of forming these two kinds of TFTs on the element substrate. Accordingly, a driving circuit has excellent performance as compared to a conventional driving circuit without increasing the number of manufacturing processes.

Operation of Sampling Switch

Next, operation of the sampling switch 202 will be described with reference to FIG. 7. FIG. 7 is a timing chart of the first sampling signal Sbi and the second sampling signal Sai supplied to the sampling switch 202. FIG. 7 shows a timing chart of the first sampling signal Sbi and the second sampling signal Sai supplied to the sampling switch 202, which correspond to adjacent groups of data lines, respectively. More specifically, for example, the TFT 202S and the TFT 202H at an n-th stage in FIG. 7 are included in the sampling switch 202 electrically connected to the data line 114*e*-12 in the i-th group of data lines shown in FIG. 5, and the TFT 202S and the TFT 202H at an (n+1)-th stage in FIG. 7 are included in the sampling switch 202 electrically connected to the data line 114*f* provided at the rearmost in the (i+1)-th group of data lines shown in FIG. 5. In other words, the first sampling signal Sbi and the second sampling signal Sai are supplied to the adjacent groups of data lines with a time difference there between. Even though it is exemplified in this embodiment that the sampling signal Si (i.e., the first sampling signal Sbi and the second sampling signal Sai) is supplied to each group of data lines with the time difference, the driving circuit of the electro-optical device of the present invention is not limited to that the sampling signal is supplied to each group of data line. For example, the driving circuit may be applied when the first sampling signal Sbi and the second sampling signal Sai are supplied to each of adjacent data lines with a time difference.

As shown in FIG. 7, when the second sampling signal Sai supplied to the TFT 202S at the n-th stage goes into a high level at a timing Tsn-on, the TFT 202S is switched from an off state to an on state. When the first sampling signal Sbi of the high level is supplied to the TFT 202H at the n-th stage at a timing Thn-on later by Δt1 than the timing Tsn-on, the TFT 202H at the n-th stage is switched from the off state to the on state. Even though the timing Thn-on is later than the timing Tsn-on in this embodiment, the timing Thn-on when the TFT 202H is switched from the off state to the on state may be a timing equal to or earlier than the timing Tsn-on.

Subsequently, when the second sampling signal Sai goes into a low level at a timing Tsn-off, the TFT 202S at the n-th stage is switched from the on state to the off state. When the first sampling signal Sbi of the low level is supplied to the TFT 202H at the n-th stage at a timing Thn-off later by Δt2 than the timing Tsn-off, the TFT 202H at the n-th stage is switched from the on state to the off state. The Δt2 is, for example, preferably 20~30 nsec, in order to reduce a leak current. In this manner, by turning the TFT 202H into the off state at a timing later than the TFT 202S, the leak current flowing from the TFT 202H of the off state to the data line can be reduced, which results in reduction of a pushdown voltage caused by the leak current. The timing Tsn-off and the timing Thn-off may be concurrent, which also may obtain a corresponding effect of reduction of the leak current. In addition, like the TFT 202S and the TFT 202H at the n-th stage, by turning a TFT 202H at a different stage into an off state at a timing later than a timing at which a TFT 202S at the different state turns into an off state, the pushdown voltage can be reduced.

As described above, the driving circuit of the electro-optical device according to this embodiment allows reduction of differences between different pushdown voltages of the data lines by reducing the pushdown voltages, thus allowing reduction of a difference of periodical image signal record on the data lines. Accordingly, it is possible to prevent occurrence of luminance deviation visible on a display screen. As a result, the electro-optical device can display images with high quality. In addition, the driving circuit of the electro-optical device according to this embodiment allows alleviation of asymmetry of image signals due to the pushdown voltage in the electro-optical device, such as an inverse-driven liquid crystal display device, by reducing the pushdown voltage, thus obtaining a remarkable effect of reducing burn-in of liquid crystal.

Modification of Sampling Switch

Next, a modification of the sampling switch will be described with reference to FIGS. 8 to 10. A sampling switch in this example is characterized in that an additional capacitor is provided between two TFTs. The sampling switch in this example has the same configuration as the above-described sampling switch 202 except for the additional capacitor, and therefore, the components common to the sampling switch 202 are denoted by the same reference numerals.

Figure 8:
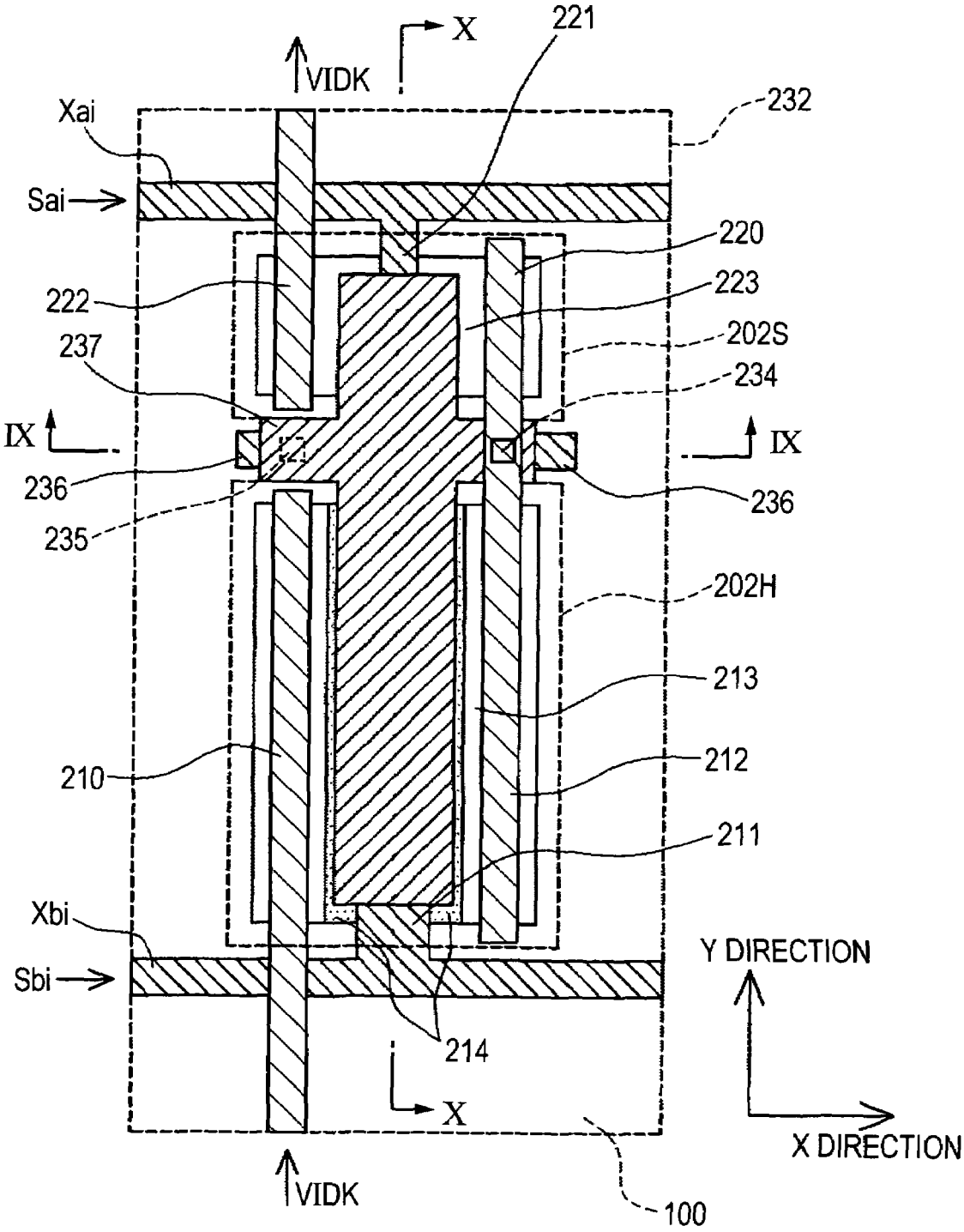
FIG. 8 is a plan view illustrating a detailed configuration of modification of the sampling switch according to an embodiment of the present invention.
Figure 9:
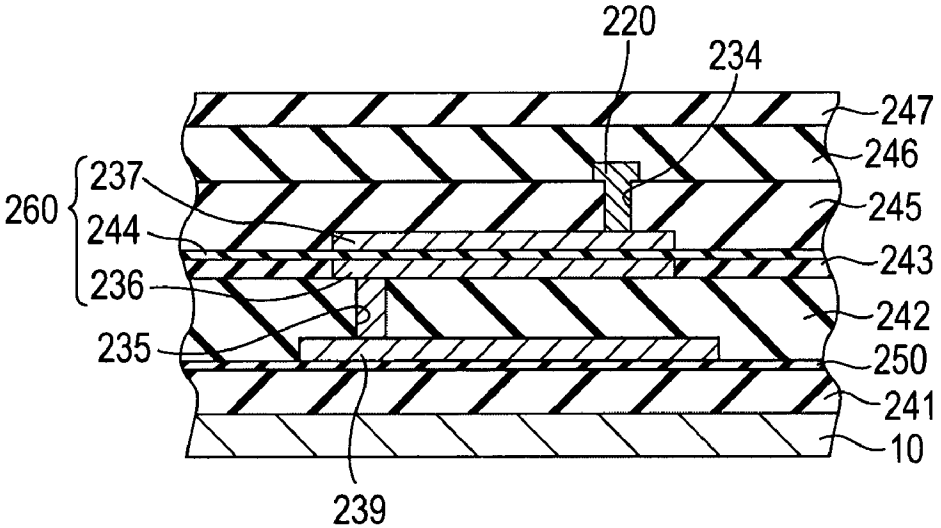
FIG. 9 is a sectional view taken along the line IX-IX of FIG. 8 according to an embodiment of the present invention.
Figure 10:
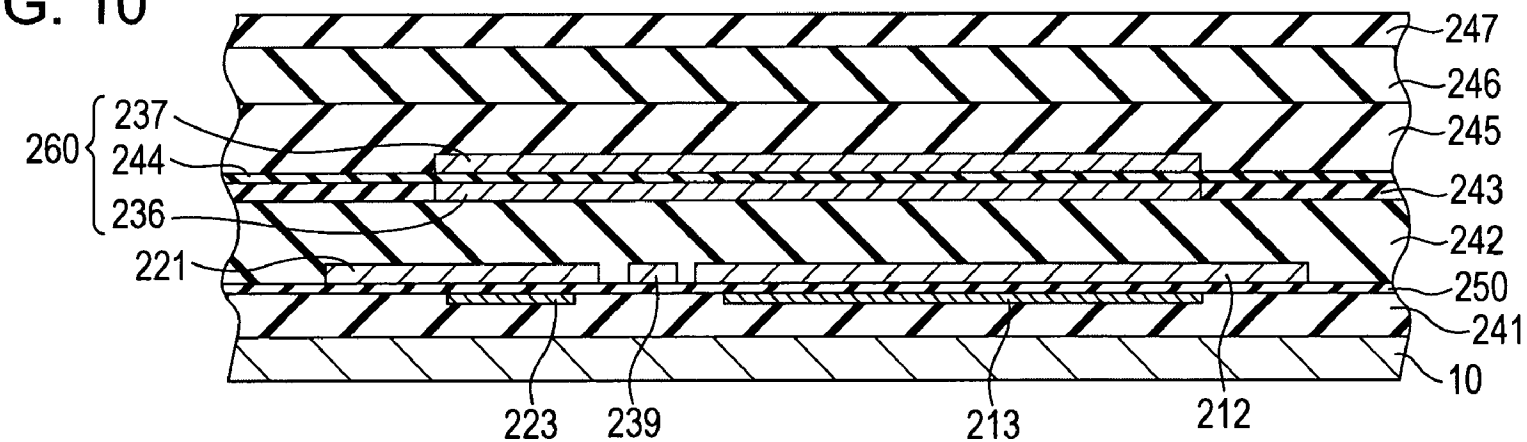
FIG. 10 is a sectional view taken along the line X-X of FIG. 8 according to an embodiment of the present invention.

FIG. 8 is a plan view illustrating a detailed configuration of a sampling switch 232, and FIGS. 9 and 10 are sectional views taken along the lines IX-IX and X-X of FIG. 8, respectively.

As shown in FIG. 8, the sampling switch 232 includes an upper capacitive electrode 237 extending across the gate electrode 211 of the TFT 202H and the gate electrode 221 of the TFT 202S, and a lower capacitive electrode 236 opposite to the upper capacitive electrode 237.

The upper capacitive electrode 237 is electrically connected, by a contact hole 234, to a portion between the TFT 202S and the TFT 202H in a portion where the drain electrode 212 extends toward the source electrode 220. The lower capacitive electrode 236 is electrically connected to a capacitive wire line 239 shown in FIGS. 9 and 10 by a contact hole 235. In addition, the capacitive wire line 239 is electrically connected to one side of a pixel electrode of a pixel portion by a wire line (not shown).

As shown in FIGS. 9 and 10, interlayer insulating film 241, 250, 242, 243, 244, 245, 246 and 247 are laminated in order on the TFT array substrate 10. The interlayer insulating film 250 becomes a gate insulating film common to the TFT 202S and the TFT 202H. The interlayer insulating film 244 forms an additional capacitor 260, together with the upper capacitive electrode 237 and the lower capacitive electrode 236 extending above and below the interlayer insulating film 244, respectively. When the upper capacitive electrode 237 composing the additional capacitor 260 is electrically connected to the drain side of the TFT 202H and the source side of the TFT 202S, the additional capacitor 260 can make a potential difference between the TFT 202H and the TFT 202S small and reduce a pushdown voltage between the source and drain sides. Accordingly, the additional capacitor 260 can reduce an off current flowing into the TFT 202S when the TFT 202H turns into an off state, therefore, it is possible to reduce supply of an erroneous signal due to the off current of the TFT 202H into the data line by the TFT 202S. The additional capacitor 260 may be changed by setting an area of the upper capacitive electrode 237 and the lower capacitive electrode 236 or a film thickness of the interlayer insulating film 244 interposed between these electrodes to be a required value. For example, if capacitance of the additional capacitor 260 is ten times gate capacitance of the TFT 202H, the pushdown voltage between the TFT 202H and the TFT 202S can be reduced such that it has no effect on quality of images.

Thus, the driving circuit in this example can reduce the pushdown voltage generated in the sampling switch, in addition to the effect obtainable by using the sampling switch 202, therefore, it is possible to improve quality of images more effectively while reducing burn-in of liquid crystal.

Electronic Apparatus

Figure 12:
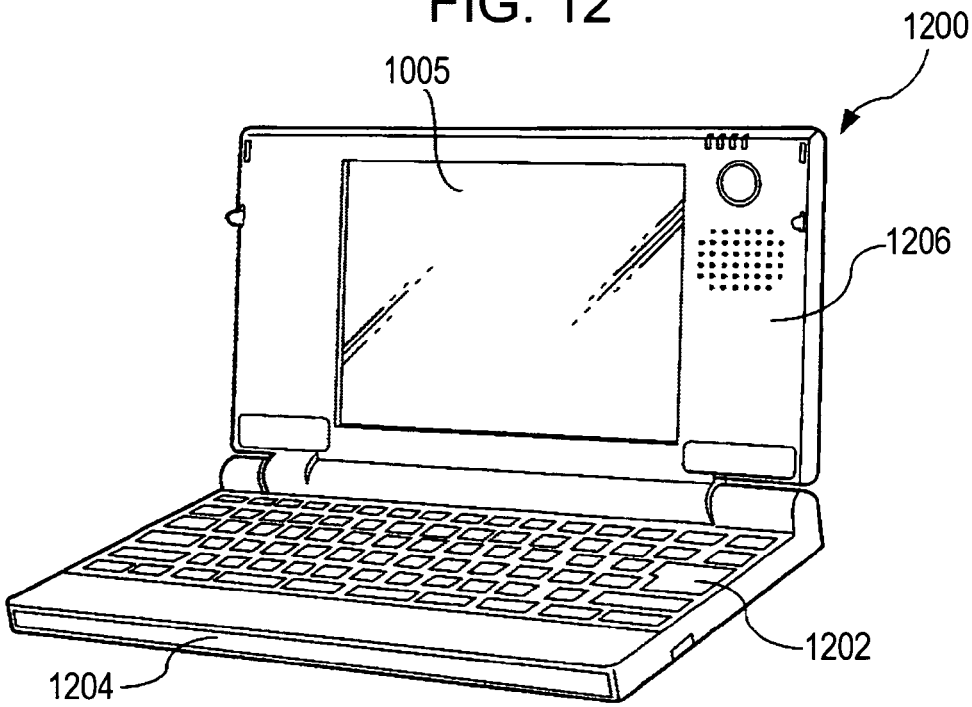
FIG. 12 is a perspective view illustrating configuration of a personal computer as an example of an electronic apparatus to which an electro-optical device of the present invention is applied.
Figure 13:
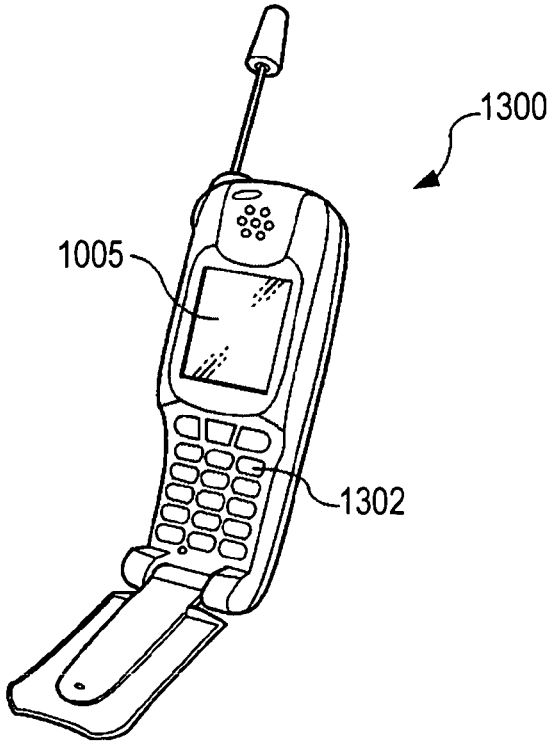
FIG. 13 is a perspective view illustrating configuration of a mobile telephone as an example of an electronic apparatus to which an electro-optical device of the present invention is applied.

Next, applications of the above-described liquid crystal display device to various electronic apparatuses will be described with reference to FIGS. 11 to 13.

Projector

First, a projector using the above-described liquid crystal display device as a light valve will be described. FIG. 11 is a plane arrangement view illustrating an exemplary configuration of a projector.

Figure 11:
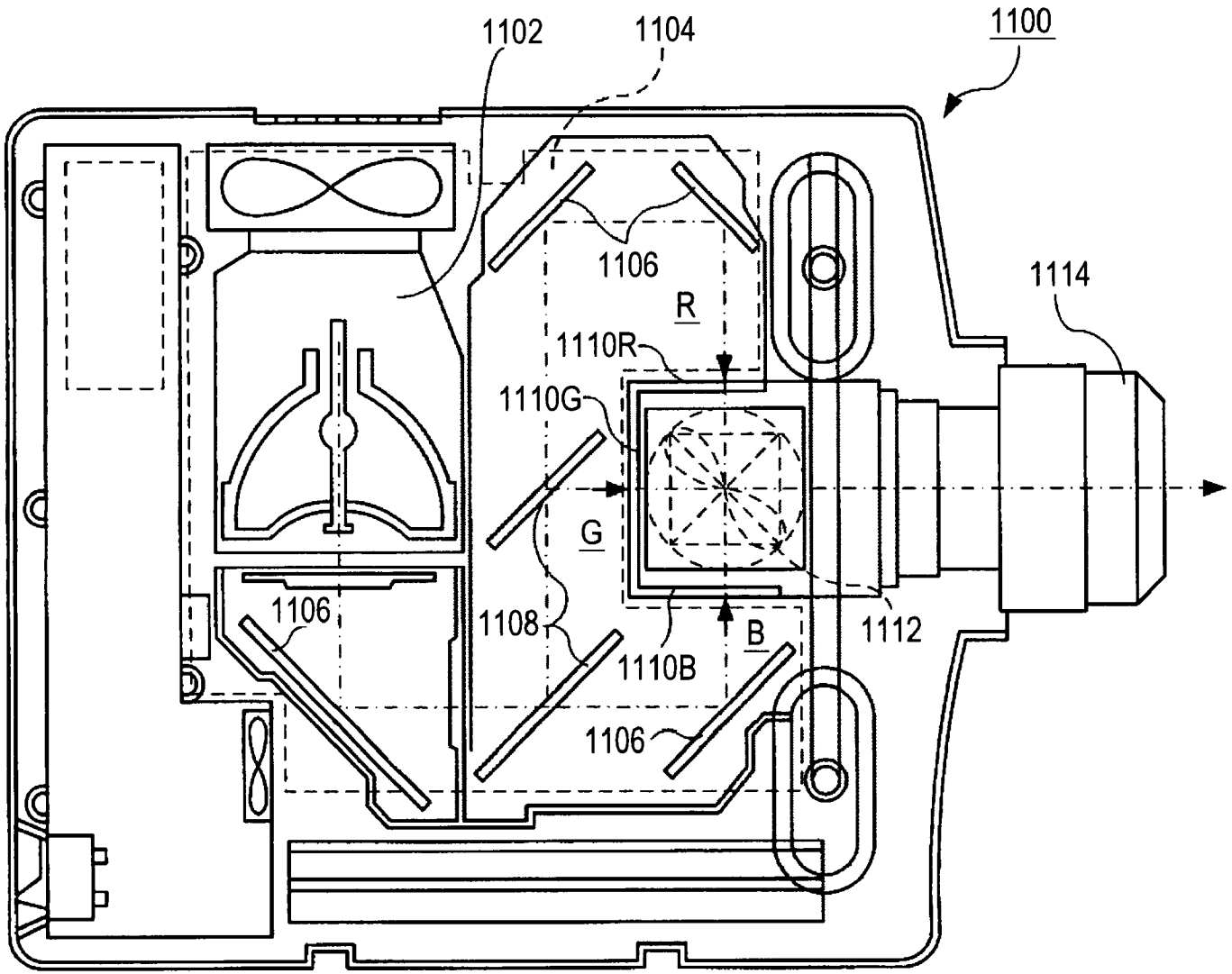
FIG. 11 is a plane arrangement view illustrating configuration of a projector as an example of an electronic apparatus to which an electro-optical device of the present invention is applied.

As shown in FIG. 11, a projector 1100 includes a lamp unit 1102 composed of a source of white light, such as a halogen lamp. Projection light projecting from the lamp unit 1102 is divided into three primary colors RGB by four mirrors 1106 and two dichroic mirrors 1108, which are arranged within a light guide 1104 and is incident on light valves 1110R, 1110B and 1110G corresponding to the three primary colors, respectively. These three light valves 1110R, 1110B and 1110G are constructed by using liquid crystal modules, each of which includes a liquid crystal display device.

The liquid crystal panels 100 in the light valves 1110R, 1110B and 1110G are driven by RGB primary color signals supplied from the respective image signal supply circuits 300. Light modulated by these liquid crystal panels 100 are incident on a dichroic prism 1112 from three directions. In the dichroic prism 1112, R and B color light is refracted by 90 degrees while G color light goes straight. Accordingly, as a result of a combination of RGB color images, a color image is projected on a screen or the like through a projection lens 1114.

Here, considering display images by the light valves 1110R, 1110B and 1110G, it is required that a display image by the light valve 1110G is inverted in the left and right with respect to display images by the light valves 1110R and 1110B.

In addition, since light corresponding to primary colors RGB is incident on the light valves 1110R, 1110B and 1110G, respectively, by the dichroic mirrors 1108, there is no need to provide color filters.

Mobile Computer

Next, an application of the above-described liquid crystal display device to a mobile personal computer will be described. FIG. 12 is a perspective view showing configuration of this personal computer. As shown in FIG. 12, a computer 1200 includes a body 1204 equipped with a keyboard 1202, and a liquid crystal display unit 1206. The liquid crystal display unit 1206 is constructed by adding a backlight on a back side of the above-described liquid crystal display device 1005.

Mobile Telephone

Next, an application of the above-described liquid crystal display device to a mobile telephone will be described. FIG. 13 is a perspective view showing configuration of this mobile telephone. As shown in FIG. 13, a mobile telephone 1300 includes a plurality of operation buttons 1302 and a reflection-typed liquid crystal display device 1005. A front light is provided at the front of the reflection-typed liquid crystal display device 1005 if necessary.

Further, in addition to the electronic apparatuses described with reference to FIGS. 11 to 13, it is to be understood that the electronic apparatus to which the electro-optical device of the present invention may be applied may include liquid crystal televisions, view finder type or monitor direct-view type video tape recorders, car navigators, pagers, electronic pocket notebooks, calculators, word processors, workstations, video conference telephones, POS terminals, apparatuses equipped with touch panels, etc.

It should be understood that the preceding is merely a detailed description of several embodiments of the present invention and that numerous changes to the disclosed embodiments can be made in accordance with the disclosure herein without departing from the spirit or scope of the invention. The scope of the invention is to be determined only by the appended claims and their equivalents. It should be understood that driving circuits for electro-optical devices, electro-optical devices including the driving circuits, and electronic apparatuses including the electro-optical devices, according to such changes, are intended to be included in the scope of the invention.

What is claimed is:

1. A driver circuit for driving an electro-optical device having a plurality of data lines and scan lines arranged in a matrix manner and a plurality of image signal lines for supplying an image signal to the data lines, the driver circuit comprising:

a data line driving circuit for sequentially supplying a first sampling signal and a second sampling signal; and a plurality of sampling switches, each of the sampling switches being electrically connected to one of the data lines and one of the image signal lines, a plurality of pixel portions formed at the intersection of the data lines and scan lines, each sampling switch comprising:

a capacitor having an upper capacitive electrode and a lower capacitive electrode, a first transistor electrically connected in series with a second transistor, a gate of the first transistor electrically connected to the data line driving circuit for receiving the first sampling signal and a source of the first transistor electrically connected to one of the image signal lines and a drain of the first transistor electrically connected to both the source of the second transistor and the upper capacitive electrode of the capacitor, a gate of the second transistor electrically connected to the data line driving circuit for receiving the second sampling signal, a drain of the second transistor electrically connected to one of the data lines to supply the image signal according to the second sampling signal, and the lower capacitive electrode electrically connected to one of the pixel portions.

2. The driver circuit according to claim 1, the first transistor having a capacitance, the capacitance of the capacitor being ten times or more greater than the capacitance of the first transistor.

3. A driving circuit for driving an electro-optical device including a plurality of scan lines, a plurality of data lines, and a plurality of pixel portions, all of which are arranged in an image display region on a substrate, the driving circuit comprising:

a sample hold circuit including sampling switches for supplying an image signal supplied by an image signal line to each of the plurality of data lines corresponding to a first sampling signal and a second sampling signal, each of the sampling switches includes a first transistor for sustaining the image signal according to the first sampling signal, a second transistor electrically connected in series to the first transistor for supplying the image signal sustained by the first transistor to the data lines according to the second sampling signal, and a capacitor to decrease a potential difference between a drain of the first transistor and a source of the second transistor; and a data line driving circuit that sequentially supplies the first sampling signal and the second sampling signal for each of the sampling switches.

4. The driving circuit according to claim 3, wherein the capacitor includes an upper capacitive electrode electrically connected to the drain of the first transistor and the source of the second transistor, a lower capacitive electrode electrically connected to an electrode of one of the plurality of pixel portions, the electrode forming a storage capacitor, and an insulating film being interposed between the upper capacitive electrode and the lower capacitive electrode.

* * * * *